US011759014B2

(12) United States Patent
Ni

(10) Patent No.: US 11,759,014 B2
(45) Date of Patent: Sep. 19, 2023

(54) MULTIFUNCTIONAL SWIVEL CHAIR TRAY AND USING METHOD THEREOF

(71) Applicant: Hangzhou Zhongtai Industrial Group Co., Ltd., Zhejiang (CN)

(72) Inventor: Yongxing Ni, Zhejiang (CN)

(73) Assignee: Hangzhou Zhongtai Industrial Group Co., Ltd., Zhejiang (CN)

( * ) Notice: Subject to any disclaimer, the term of this patent is extended or adjusted under 35 U.S.C. 154(b) by 488 days.

(21) Appl. No.: 17/042,205

(22) PCT Filed: Oct. 28, 2019

(86) PCT No.: PCT/CN2019/113577
§ 371 (c)(1),
(2) Date: Sep. 28, 2020

(87) PCT Pub. No.: WO2021/068299
PCT Pub. Date: Apr. 15, 2021

(65) Prior Publication Data

US 2023/0148753 A1 May 18, 2023

(30) Foreign Application Priority Data

Oct. 8, 2019 (CN) ..... 201910951186.1

(51) Int. Cl.
*A47C 1/032* (2006.01)
*A47C 3/18* (2006.01)
(Continued)

(52) U.S. Cl.
CPC ..... *A47C 1/03255* (2013.01); *A47C 1/03238* (2013.01); *A47C 1/03266* (2013.01);
(Continued)

(58) Field of Classification Search
CPC ..... A47C 1/0327; A47C 1/03238; A47C 1/03266; A47C 1/03274
See application file for complete search history.

(56) References Cited

U.S. PATENT DOCUMENTS 3,434,756 A * 3/1969 Walkinshaw ..... A47C 1/026 297/301.7
4,384,741 A * 5/1983 Flum ..... A47C 1/026 297/303.4
(Continued)

FOREIGN PATENT DOCUMENTS

CN 201379282 1/2010
CN 202553026 11/2012
(Continued)

OTHER PUBLICATIONS

"International Search Report (Form PCT/ISA/210) of PCT/CN2019/113577," dated Jul. 1, 2020, pp. 1-5.

*Primary Examiner* — Rodney B White
(74) *Attorney, Agent, or Firm* — JCIPRNET

(57) ABSTRACT

A multifunctional swivel chair tray includes a main body. The main body is connected with a warping plate through a second rotating shaft. An ascending and descending block penetrates through the second rotating shaft. The ascending and descending block is connected with an ascending and descending driving mechanism. A first adjusting rod penetrates through one side of the main body. The first adjusting rod is connected with a multi-spring grouping adjusting mechanism. A second adjusting rod is arranged on another side of the main body. The second adjusting rod is connected with a gear adjusting mechanism. The warping plate is connected with a base plate through a third rotating shaft. A slide plate is slidably connected onto the base plate. A slide plate locking mechanism is arranged between the base plate and the slide plate.

14 Claims, 10 Drawing Sheets

(51) Int. Cl.
*A47C 3/30* (2006.01)
*A61H 7/00* (2006.01)

(52) U.S. Cl.
CPC ..... *A47C 1/03274* (2018.08); *A47C 3/18* (2013.01); *A47C 3/30* (2013.01); *A61H 7/001* (2013.01); *A61H 2201/0149* (2013.01); *A61H 2205/088* (2013.01)

(56) References Cited

U.S. PATENT DOCUMENTS 5,026,117 A * 6/1991 Faiks ..... A47C 7/441 297/303.4
5,160,184 A * 11/1992 Faiks ..... A47C 3/026 297/303.4
6,033,020 A * 3/2000 Ito ..... A47C 7/444 297/328
6,276,755 B1 8/2001 Su
6,588,843 B1 * 7/2003 Ebenstein ..... A47C 1/031 297/301.4
6,712,428 B2 * 3/2004 Moreschi ..... A47C 1/03272 297/303.4
6,957,862 B2 * 10/2005 Chen ..... A47C 1/026 297/316
7,014,262 B2 * 3/2006 Rossetto ..... A47C 1/03238 297/301.7
7,080,884 B2 * 7/2006 Daeschle ..... A47C 1/03266 297/303.4
7,293,832 B2 * 11/2007 Huang ..... A47C 1/03238 297/301.7
7,815,257 B2 * 10/2010 Costaglia ..... A47C 1/03255 297/303.5
7,866,749 B2 * 1/2011 Costaglia ..... A47C 1/03238 297/301.7
8,979,200 B2 * 3/2015 Chen ..... A47C 3/026 297/302.7
9,386,858 B2 * 7/2016 Chen ..... A47C 1/024
10,231,545 B2 * 3/2019 Moreschi ..... A47C 3/0255
11,607,055 B2 * 3/2023 Hu ..... A47C 3/20
2007/0040433 A1 * 2/2007 Huang ..... A47C 1/03255 297/325

FOREIGN PATENT DOCUMENTS

CN 203506088 4/2014
CN 207590324 7/2018
CN 208491344 2/2019
CN 209252114 8/2019
CN 209269045 8/2019

* cited by examiner

MULTIFUNCTIONAL SWIVEL CHAIR TRAY AND USING METHOD THEREOF

CROSS-REFERENCE TO RELATED APPLICATION

This application is a 371 of international application of PCT application serial no. PCT/CN2019/113577, filed on Oct. 28, 2019, which claims the priority benefit of China application no. 201910951186.1, filed on Oct. 8, 2019. The entirety of each of the above mentioned patent applications is hereby incorporated by reference herein and made a part of this specification.

BACKGROUND

Technical Field

The present invention relates to a swivel chair tray, and more particularly relates to a multifunctional swivel chair tray and using method thereof.

Description of Related Art

A currently known swivel chair tray consists of an upper tray, a lower support beam, a support shaft and spring device components. A swivel chair can make proper pitching around the support shaft just after the upper tray and the back of a swivel chair seat are fixed, which can make a user feel comfortable. A Chinese patent (Publication Number: CN 2587252Y) discloses a tray, which mainly includes a base plate, a movable seat, a tapered tube and an adjusting device. The movable seat is fixedly connected to the base plate, a tapered tube fixing plate is arranged on the other side of the movable seat, and the taper tube fixing plate, the movable seat and the tapered tube are fixedly connected. The adjusting device includes an adjusting rod, an adjusting plate, a torsion spring, and a torsion spring fixing plate. The adjusting rod is inserted in the movable seat, the adjusting plate is fixedly connected to the end of the adjusting rod that is inserted in the movable seat, one surface of the adjusting plate is in contact with an air pressure rod, and the other surface is connected to the torsion spring. An adjusting plate rotation stopping pad is arranged on the other surface of the adjusting plate. The movable seat is riveted to the base plate with a rivet, the tapered tube is welded in the central position of the movable seat, the torsion spring and the torsion spring fixing plate are both wound on the rivet, one end of the torsion spring is fixed on the torsion spring fixing plate, and an adjusting plate blister is arranged on the adjusting plate. A locking mechanism is arranged on the tray, and the locking mechanism mainly includes a fixing block, the rivet, an adjusting rod, a roller seat, a roller, a roller pin, an adjusting sleeve, an adjusting bolt, a compression spring, a fixing seat, a brake pad, a steel sleeve, and a locking nut. The fixing block is fixedly connected to the movable seat, and the rivet movably penetrates into the end of the fixing block. One end of the brake pad is movably fixed in the center of the rivet, and a long kidney-shaped hole is formed in the other end of the brake pad. The adjusting bolt penetrates into the hole, one end of the adjusting bolt is screwed with a locking nut and sheathed in a steel sleeve, the outer surface of the steel sleeve movably matches one side surface of the fixing seat, the fixing seat is fixedly connected to the base plate, the other side surface of the fixing seat is fixedly connected to the adjusting sleeve, and the compression spring is in clearance fit with the inner side of the fixing seat.

The compression spring is wound around the adjusting bolt, the end surface of the adjusting bolt is pressed against the roller, which is riveted on the roller seat with the roller pin, the rivet penetrates into the side surface of the roller seat, and the side surface of the roller seat is in movable connection with the adjusting sleeve. The adjusting rod is welded on the inner side of the other end of the roller seat. However, this kind of swivel chair tray has the disadvantages that the functions of the swivel chair tray are less, operations during ascending and descending, spring force and gear adjustment are more complicated, additionally, the base plate cannot slide and cannot be tightly locked, the integration degree is poorer, the layout of the swivel chair tray is more unreasonable, and the size is larger.

SUMMARY

The present invention provides a multifunctional swivel chair tray and use methods thereof, mainly solving the technical problems in the prior art that the functions of the swivel chair tray are less, operations during ascending and descending, spring force and gear adjustment are more complicated, additionally, a base plate cannot slide and cannot be tightly locked, the integration degree is poorer, the layout of the swivel chair tray is more unreasonable, the size is larger, and the like.

The present invention mainly solves the above technical problems by the following technical solutions.

A multifunctional swivel chair tray of the present invention includes a main body. An ascending and descending rod connecting hole is formed in the main body. The main body is connected with a warping plate through a second rotating shaft. An ascending and descending block penetrates through the second rotating shaft. The ascending and descending block is positioned above the ascending and descending rod connecting hole. The ascending and descending block is connected with an ascending and descending driving mechanism. A first adjusting rod penetrates through one side of the main body. The first adjusting rod is connected with a multi-spring grouping adjusting mechanism. A second adjusting rod is arranged on another side of the main body. The second adjusting rod is connected with a gear adjusting mechanism. The warping plate is connected with a base plate through a third rotating shaft. A slide plate is slidably connected onto the base plate. A slide plate locking mechanism is arranged between the base plate and the slide plate. The present invention integrates the ascending and descending driving mechanism, the multi-spring grouping adjusting mechanism, the gear adjusting mechanism and the slide plate locking mechanism all into one swivel chair tray, so that a plurality of components can be integrated in a smaller space of the swivel chair tray. Therefore, a swivel chair has the functions of ascending and descending, spring force adjustment, gear adjustment, front-back adjustment, etc., and the layout is reasonable.

As a preference, the ascending and descending driving mechanism includes a first handle connected to one side of the main body. The first handle is sleeved outside of the first adjusting rod. An ascending and descending adjusting plate is arranged at an inner end of the first handle. The ascending and descending adjusting plate is connected with an ascending and descending pull rod. The other end of the ascending and descending pull rod is in contact with the ascending and descending block. The ascending and descending block includes a pipe body penetrating through the second rotating shaft. A first plate member capable of touching the ascending and descending pull rod, and a second plate member capable of being in contact with an air pressure rod at the ascending and descending rod connecting hole are respectively arranged on the pipe body. The first plate member and the second plate member face opposite directions. A handlebar is arranged at a side face of the first handle of the present invention, so that the first handle is convenient to rotate. A circular arc groove may be formed in the main body. The ascending and descending pull rod penetrates through the circular arc groove, so that the position of the ascending and descending pull rod can be limited. The air pressure rod at the ascending and descending rod connecting hole is consistent with that in the prior art, and an air pressure ascending and descending mechanism on the swivel chair is also a commercially available general product.

As a preference, the multi-spring grouping adjusting mechanism includes a first main spring seat, a first auxiliary spring seat and a second auxiliary spring seat connected onto the warping plate. The first main spring seat is connected with a main spring. The other end of the main spring is fixed on the main body through a second main spring seat. The first auxiliary spring seat and the second auxiliary spring seat are respectively connected with a first auxiliary spring and a second auxiliary spring. The other end of the first auxiliary spring is connected with a first third auxiliary spring seat. The other end of the second auxiliary spring is connected with a fourth auxiliary spring seat. An adjusting mechanism is respectively arranged at an outer end of the third auxiliary spring seat and an outer end of the fourth auxiliary spring seat. A guide block is arranged below the first auxiliary spring and the second auxiliary spring. The first auxiliary spring and the second auxiliary spring are respectively arranged on two sides of the main spring. Additionally, through the adjusting mechanism, the state can be switched to be that only the main spring is stressed, or the main spring is mutually matched with the first auxiliary spring and the second auxiliary spring to be stressed. The stress distribution of 3 springs can be realized through different combinations. The guide block can guide the first auxiliary spring and the second auxiliary spring.

As a preference, the adjusting mechanism at the outer end of the first third auxiliary spring seat includes a first auxiliary spring adjusting block. The adjusting mechanism at the outer end of the fourth auxiliary spring seat includes a second auxiliary spring adjusting block. The first auxiliary spring adjusting block and the second auxiliary spring adjusting block penetrate through a support rod. A jacking block is respectively arranged at two ends of the first auxiliary spring adjusting block. A jacking block is respectively arranged on one side and one end of the second auxiliary spring adjusting block. After rotating, the support rod can drive the first auxiliary spring adjusting block and the second auxiliary spring adjusting block to rotate, so that the first third auxiliary spring seat and the fourth auxiliary spring seat can be jacked to move, and the first auxiliary spring and the second auxiliary spring are adjusted. The two jacking blocks on the first auxiliary spring adjusting block are arranged in a line, and the two jacking blocks on the second auxiliary spring adjusting block are arranged in an L shape.

As a preference, the support rod is connected with a first gear. The first gear is engaged with a second gear. The second gear is connected with the first adjusting rod. The cross section of the support rod is in a hexagon shape. A hexagonal hole adapting to the cross section of the support rod is respectively formed in the middle of the first auxiliary spring adjusting block and the second auxiliary spring adjusting block. An outer end of the first adjusting rod is connected with a first adjusting handwheel. A divided wheel penetrates through the support rod. A small compression spring is arranged on the main body. The small compression spring is connected with a steel ball. The steel ball jacks on the divided wheel. By using the four-station divided wheel, the steel ball and the small compression spring, the main spring, the first auxiliary spring and the second auxiliary spring can be mutually matched in four ways. A circular arc surface accommodating the steel ball may be arranged on the periphery of the divided wheel.

As a preference, the gear adjusting mechanism includes a second adjusting handwheel connected with an outer end of the second adjusting rod. An inner end of the second adjusting rod is connected with a gear adjusting block. The gear adjusting block is connected with a gear pull rod. The other end of the gear pull rod is connected with a locking pad through a gear torsion spring. A warping plate protection pad is connected onto the warping plate. A gear pad is arranged on an inner side of the warping plate protection pad. A plurality of lock holes are formed in a longitudinal direction of the gear pad, and the locking pad is capable of being inserted into the plurality of lock holes. The gear adjusting block may be fixed on the inner end of the second adjusting rod through a connecting member, so that the gear adjusting block can rotate along with the second adjusting rod.

As a preference, an elastic block is arranged below the gear adjusting block. A pressing plate is fixed on the main body. The pressing plate is positioned above the locking pad. A screw is arranged on the pressing plate. The gear torsion spring is connected onto the screw. The gear torsion spring penetrates through a long hole formed in the pressing plate to be connected with the locking pad. By using one pressing plate, the position of the locking pad can be limited, an effect of fixing the gear torsion spring can also be achieved, and the integration degree is high. The edge positions of the pressing plate can be fixed on the main body through another two screws.

As a preference, the slide plate locking mechanism includes a second handle connected to the other side of the main body. The second handle is sleeved outside of the second adjusting rod. A slide plate adjusting plate is arranged at an inner end of the second handle. The slide plate adjusting plate is connected with a slide plate pull rod. The slide plate pull rod is connected with an adjusting block. A plurality of slide plate lock holes are formed in the slide plate. A fixing seat is fixed on the base plate. A slide plate locking pad capable of being inserted into the slide plate lock holes is arranged in the fixing seat. The slide plate locking pad is in a crisscross shape. A slide plate compression spring is arranged between the slide plate locking pad and the fixing seat. The base plate and the slide plate may be connected in a way of penetrating a screw stud in slide grooves formed in the base plate and the slide plate, so that the free sliding can be realized between the slide plate and the base plate under the unlocked condition. The slide plate compression spring can press the slide plate locking pad back into the slide plate lock hole.

As a preference, a position limiting slide groove is formed in the adjusting block. The slide plate pull rod penetrates through the position limiting slide groove. An inclined surface is arranged on the adjusting block. A clamp groove is respectively formed in an upper end and a lower end of the inclined surface. A clamp pin capable of sliding on the inclined surface is connected onto the slide plate locking pad. An end portion of the slide plate pull rod may be a hook body hooked in the position limiting slide groove. After the adjusting block slides, the height position of the clamp pin on the inclined surface can be changed, so that the slide plate locking pad can extend and retract. When the slide plate locking pad slides into the clamp grooves at two ends of the inclined surface, self-locking or unlocking can be completed.

As a preference, a connecting seat is connected onto the main body. The ascending and descending rod connecting hole penetrates through upper and lower ends of the connecting seat. A universal ball head is arranged at the upper end of the connecting seat. A spherical slotted hole is formed in the main body. The universal ball head is mounted in the spherical slotted hole in a way of being capable of performing universal rotation. A circle of guide groove uniformly distributed in a circumference direction is arranged on an outer wall of the universal ball head. The guide groove is of an inwards recessed arc-shaped curve surface structure. A plurality of massage mechanisms are uniformly distributed and mounted on the main body. The massage mechanism includes a push rod, a connecting rod, an ascending and descending guide groove, a slide block, an ascending and descending rod and an ascending and descending seat. The ascending and descending guide groove is fastened and connected onto the main body. The push rod is movably inserted and mounted on the main body. One end of the push rod is abutted against and connected onto the guide groove, and the other end of the push rod is hinged to the connecting rod. The slide block is mounted on the ascending and descending guide groove in a way of being capable of vertically sliding. A first pushing groove in inclined arrangement is formed in the slide block. A second pushing groove in inclined arrangement is formed in the ascending and descending guide groove. The first pushing groove and the second pushing groove form a V-shaped structure together. A hinging rod is connected between the first pushing groove and the second pushing groove. The connecting rod and the hinging rod are hinged together. A lower end of the ascending and descending rod is connected with the slide block. An upper end of the ascending and descending rod is connected with the ascending and descending seat. A plurality of massage rods configured to penetrate through a chair base plate are arranged on the ascending and descending seat at intervals. A seat cushion is arranged on the chair base plate. A massage head for massaging the hip is arranged at an upper end of the massage rod. The massage head is arranged at a lower end position of the seat cushion. A support seat capable of realizing ascending and descending locking is sleeved over the connecting seat. The main body is supported on the support seat.

After long-time sitting, posture adjusting massage is capable of being performed. The support seat is moved downwards, so that the support seat leaves away from the main body. Universal rotation is capable of being realized between the universal ball head and the spherical slotted hole on the main body. A person sitting on the chair swings while rotating. The two hands hold chair armrests to prevent tilting. Various postures of the human body are adjusted, and an uncomfortable phenomenon after long-time sitting can be prevented. When an end portion of the push rod slides onto the outer wall of the universal ball head from the guide groove, the push rod is outwards pushed out. The slide block is driven to move upwards through the connecting rod, the first pushing groove and the second pushing groove, so that the massage rod moves upwards, and the massage head is abutted against and connected onto the seat cushion to perform touching massage on the hip of the human body. The numbness of the hip after long-time sitting is prevented. After being moved upwards, the support seat is locked, so that the main body is supported on the support seat to limit the positions of the guide groove and the universal ball head, and mutual swinging between the guide groove and the universal ball head is prevented.

A using method of the multifunctional swivel chair tray includes as follows.

a. When an ascending and descending function is used, rotating the first handle, so that the ascending and descending adjusting plate at the inner end of the first handle drives the ascending and descending pull rod to move, the ascending and descending pull rod is in contact with the first plate member of the ascending and descending block and drives the ascending and descending block to swing around the second rotating shaft, the second plate member of the ascending and descending block is capable of being in contact with the air pressure rod at the ascending and descending rod connecting hole so as to open an air path and complete ascending and descending of the chair.

b. When a multi-spring grouping adjusting function is used, rotating the first adjusting handwheel, so that the first adjusting handwheel drives the second gear to rotate through the first adjusting rod, the second gear drives the support rod to rotate through the first gear, the support rod drives the first auxiliary spring adjusting block and the second auxiliary spring adjusting block to rotate, the divided wheel penetrating through the support rod rotates under the joint effect of the small compression spring and the steel ball, and per quarter circle of rotation of the divided wheel is one station.

Firstly, the first auxiliary spring adjusting block is not in contact with the third auxiliary spring seat, and the second auxiliary spring adjusting block is not in contact with the fourth auxiliary spring seat. That is, both the first auxiliary spring and the second auxiliary spring are not stressed, and only the main spring is stressed.

The support rod drives the divided wheel to rotate for a quarter circle, the first auxiliary spring adjusting block is in contact with the first third auxiliary spring seat and the second auxiliary spring adjusting block is not in contact with the fourth auxiliary spring seat. That is, the second auxiliary spring is not stressed, and the main spring and the first auxiliary spring are stressed.

The support rod drives the divided wheel to rotate for a quarter circle again, the first auxiliary spring adjusting block is not in contact with the first third auxiliary spring seat, and the second auxiliary spring adjusting block is in contact with the fourth auxiliary spring seat. That is, the third auxiliary spring seat is not stressed, and the main spring and the second auxiliary spring adjusting block are stressed.

The support rod drives the divided wheel to rotate for a quarter circle again, the first auxiliary spring adjusting block is in contact with the third auxiliary spring seat, and the second auxiliary spring adjusting block is in contact with the fourth auxiliary spring seat. That is, the third auxiliary spring seat, the second auxiliary spring adjusting block and the main spring are all stressed.

According to a use method of the multifunctional swivel chair tray, when a gear adjusting function is used, and after the warping plate is swung to a certain position, the second adjusting handwheel is rotated, and the second adjusting rod drives the gear adjusting block to rotate. The elastic block positions the gear adjusting block. The gear adjusting block drives the gear pull rod to pull the gear torsion spring. After the gear torsion spring rotates, the locking pad is driven to extend out. The locking pad is capable of being inserted into one of the plurality of lock holes of the gear pad. After the second adjusting handwheel is rotated reversely, the locking pad is capable of leaving away from the lock hole. The warping plate is capable of freely moving.

According to a use method of the multifunctional swivel chair tray, when a slide plate locking function is used, the second handle is rotated, the slide plate adjusting plate at the inner end of the second handle drives the slide plate pull rod to move. The slide plate pull rod pulls the adjusting block. The clamp pin is capable of sliding on the inclined surface. After the clamp pin is positioned in the high-position clamp groove, the slide plate locking pad is capable of leaving away from the slide plate lock hole on the slide plate. Relative free sliding is capable of being realized between the slide plate and the base plate. After the second handle is released, the slide plate locking pad is jacked back into the adjusted slide plate lock hole by using the elasticity of the slide plate compression spring. The slide plate locking function is realized. At the same time, through force transmission by the clamp pin, the adjusting block is capable of being retreated back to an initial position.

According to a use method of the multifunctional swivel chair tray, after long-time sitting, posture adjusting massage is capable of being performed. The support seat is moved downwards, so that the support seat leaves away from the main body. Universal rotation is capable of being realized between the universal ball head and the spherical slotted hole on the main body. A person sitting on the chair swings while rotating. When the end portion of the push rod slides onto the outer wall of the universal ball head from the guide groove, the push rod is outwards pushed out. The slide block is driven to move upwards through the connecting rod, the first pushing groove and the second pushing groove, so that the massage rod moves upwards, the massage head is abutted against and connected onto the seat cushion to perform touching massage on the hip of the human body. The numbness of the hip after long-time sitting is prevented. After being moved upwards, the support seat is locked, so that the main body is supported on the support seat to limit the positions of the guide groove and the universal ball head, and mutual swinging between the guide groove and the universal ball head is prevented.

Therefore, the functions of the swivel chair tray of the present invention are various. Operations during ascending and descending, spring force and gear adjustment are simpler. Additionally, the base plate can slide, and can be tightly locked, the integration degree is higher, the layout of the swivel chair tray is more reasonable, and the size is smaller. The posture adjusting massage is capable of being performed after long-time sitting, and the occurrence of an uncomfortable phenomenon after long-time sitting is avoided.

DESCRIPTION OF THE EMBODIMENTS

The technical solution of the present invention is further specifically described through the following embodiments in combination of the accompanying drawings.

Figure 1:
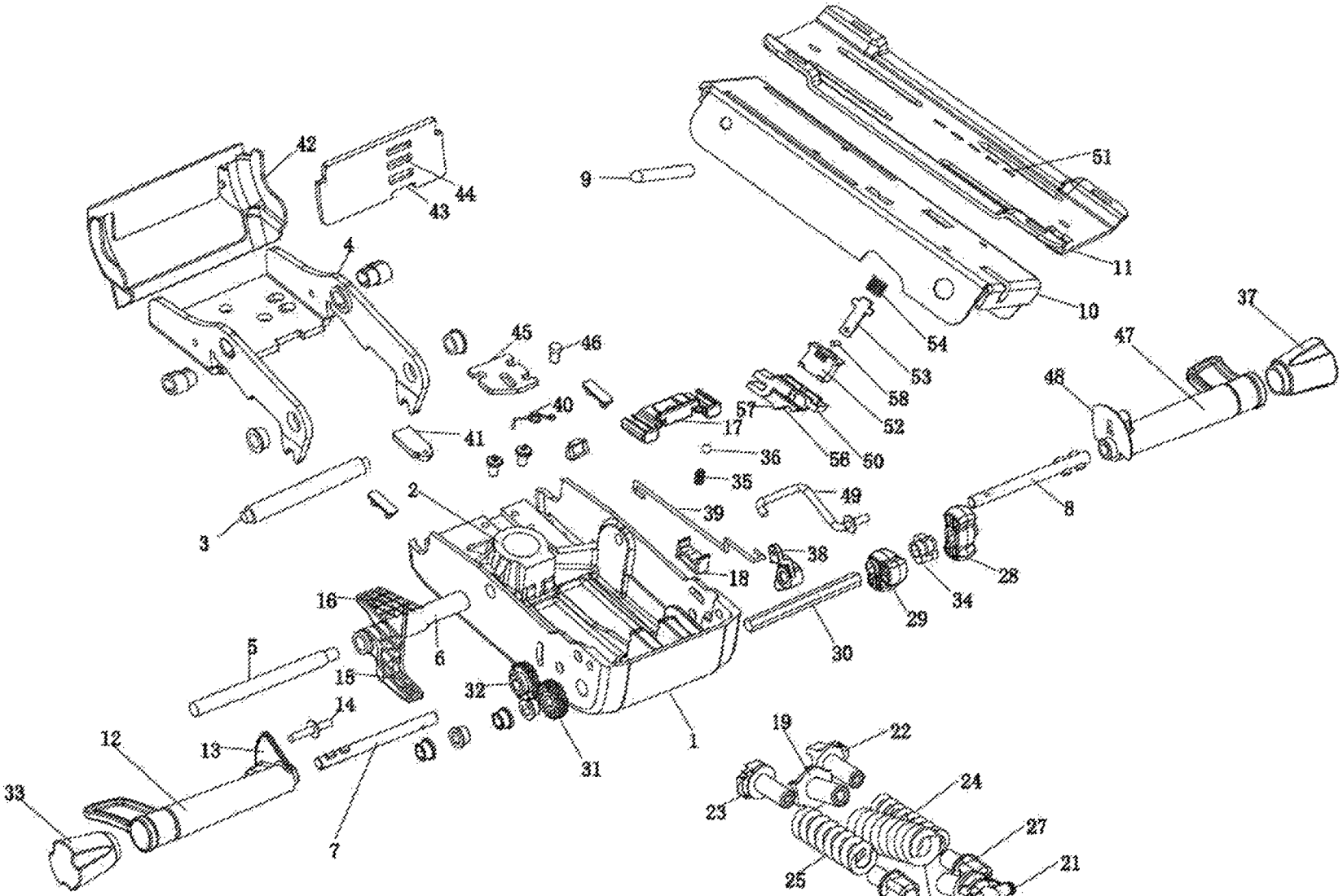
FIG. 1 is a schematic structure diagram of the present invention.

Embodiment 1: A multifunctional swivel chair tray, as shown in FIG. 1, includes a main body 1. An ascending and descending rod connecting hole 2 is formed in the main body. The main body is connected with a warping plate 4 through a second rotating shaft 5. An ascending and descending block 6 penetrates through the second rotating shaft. The ascending and descending block is positioned above the ascending and descending rod connecting hole. The ascending and descending block is connected with an ascending and descending driving mechanism. A first adjusting rod 7 penetrates through one side of the main body. The first adjusting rod is connected with a multi-spring grouping adjusting mechanism. A second adjusting rod 8 is arranged on another side of the main body. The second adjusting rod is connected with a gear adjusting mechanism. The warping plate is connected with a base plate 10 through a third rotating shaft 9. A first rotating shaft 3 is connected between the base plate and the warping plate. A slide plate 11 is slidably connected onto the base plate. A slide plate locking mechanism is arranged between the base plate and the slide plate.

Figure 2:
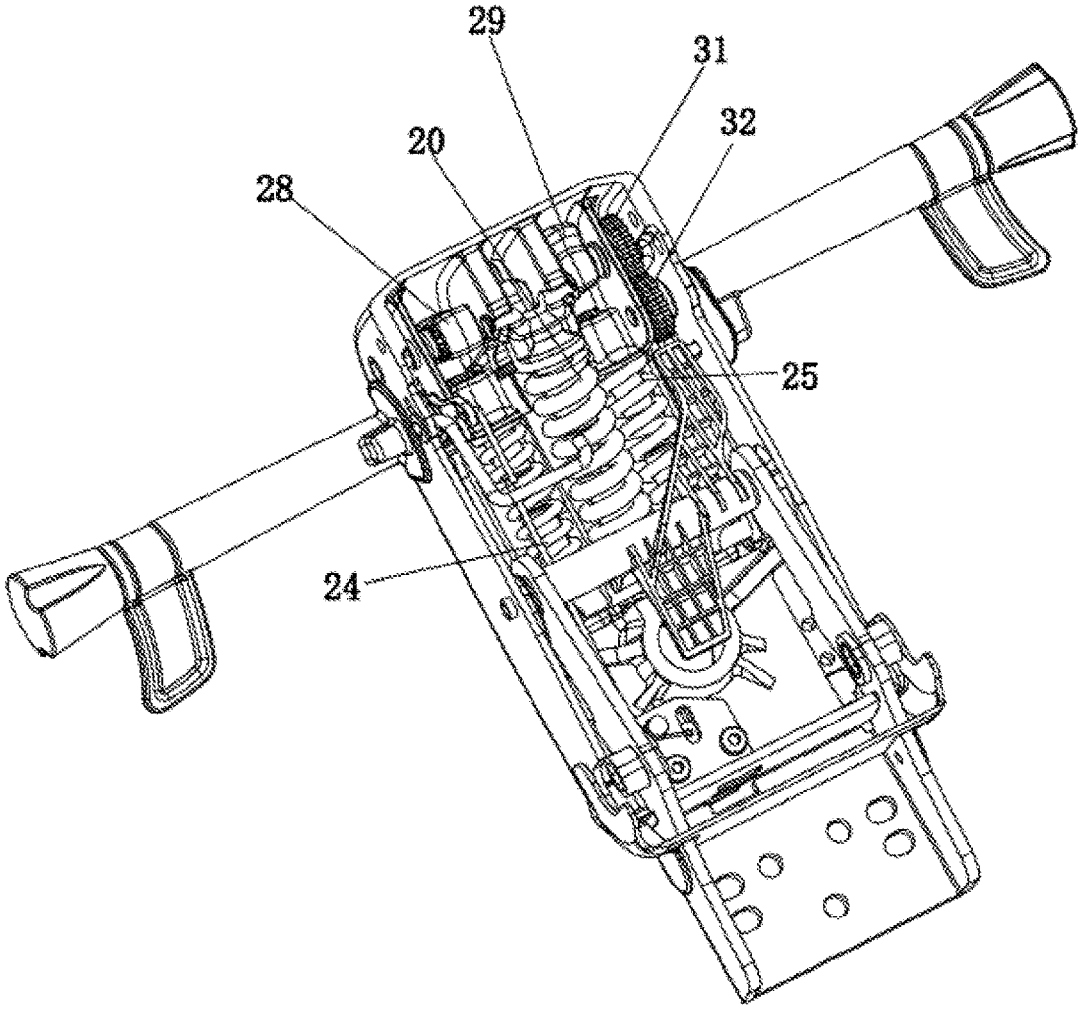
FIG. 2 is a schematic structure diagram of an ascending and descending driving mechanism of the present invention.

As shown in FIG. 2, the ascending and descending driving mechanism includes a first handle 12 connected to one side of the main body 1. The first handle is sleeved outside of the first adjusting rod 7. An ascending and descending adjusting plate 13 is arranged at an inner end of the first handle. The ascending and descending adjusting plate is connected with an ascending and descending pull rod 14. The other end of the ascending and descending pull rod is in contact with the ascending and descending block 6. The ascending and descending block includes a pipe body penetrating through the second rotating shaft 5. A first plate member 15 capable of touching the ascending and descending pull rod, and a second plate member 16 capable of being in contact with an air pressure rod at the ascending and descending rod connecting hole 2 are respectively arranged on the pipe body. The first plate member and the second plate member face opposite directions.

Figure 3:
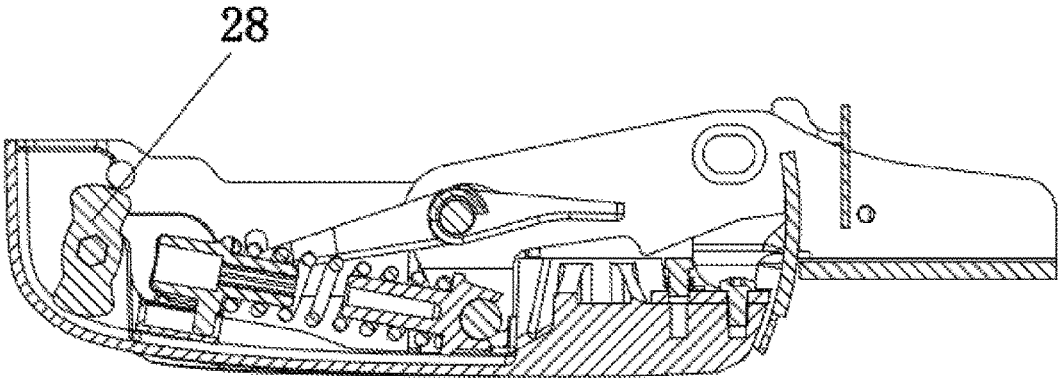
FIG. 3 is a schematic structure diagram of a multi-spring grouping adjusting mechanism of the present invention.
Figure 4:
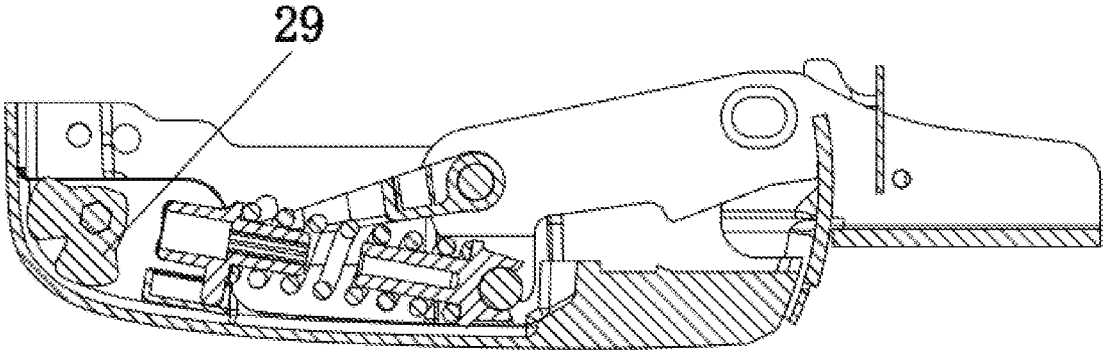
FIG. 4 is a schematic cross-sectional view of a first auxiliary spring of the present invention.
Figure 5:
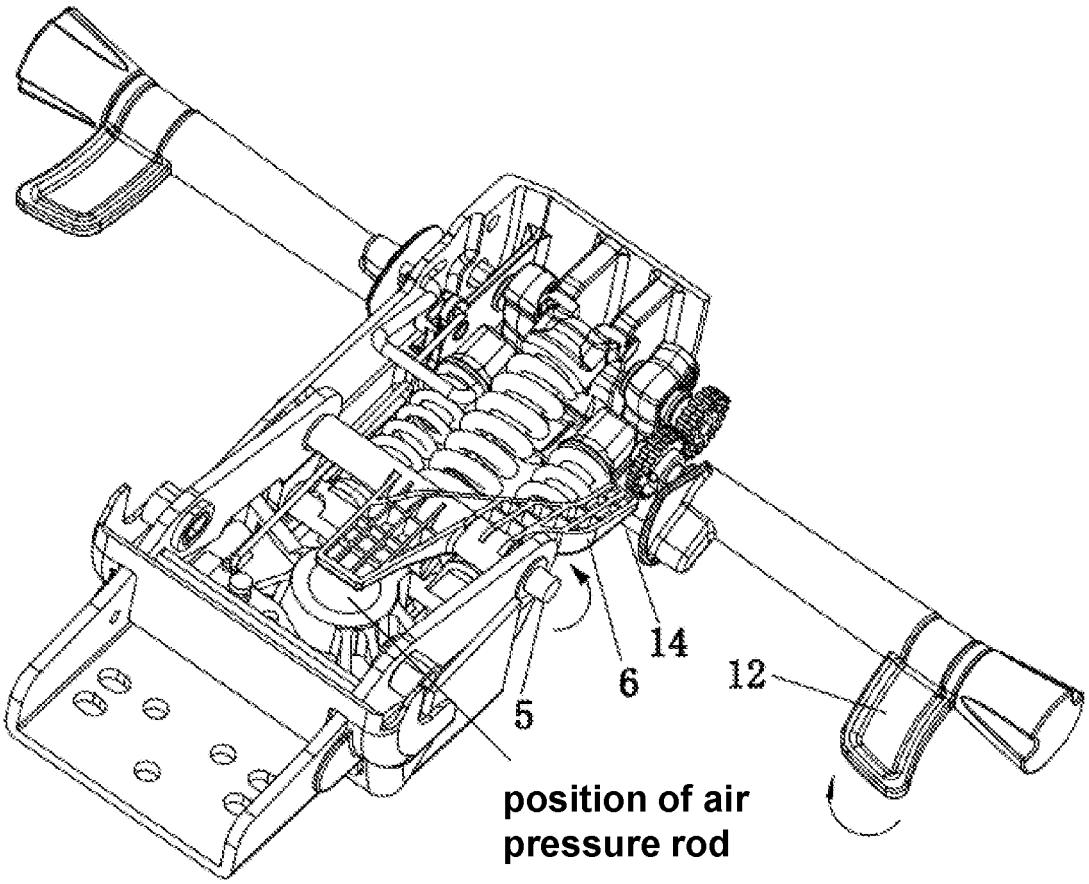
FIG. 5 is a schematic cross-sectional view of a second auxiliary spring of the present invention.

As shown in FIG. 3, FIG. 4 and FIG. 5, the multi-spring grouping adjusting mechanism includes a first main spring seat 19, a first auxiliary spring seat 22 and a second auxiliary spring seat 23 connected onto the warping plate 4. The first main spring seat 19 is connected with a main spring 20. The other end of the main spring is fixed on the main body 1 through a second main spring seat 21. The first auxiliary spring seat 22 and the second auxiliary spring seat 23 are respectively connected with a first auxiliary spring 24 and a second auxiliary spring 25. The other end of the first auxiliary spring is connected with a third auxiliary spring seat 26. The other end of the second auxiliary spring is connected with a fourth auxiliary spring seat 27. An adjusting mechanism is respectively arranged at an outer end of the third auxiliary spring seat and the fourth auxiliary spring seat. A guide block 17 is arranged below the first auxiliary spring 24 and the second auxiliary spring 25. The adjusting mechanism at the outer end of the third auxiliary spring seat 26 includes a first auxiliary spring adjusting block 28. The adjusting mechanism at the outer end of the fourth auxiliary spring seat 27 includes a second auxiliary spring adjusting block 29. The first auxiliary spring adjusting block and the second auxiliary spring adjusting block penetrate through a support rod 30. A jacking block is respectively arranged at two ends of the first auxiliary spring adjusting block. A jacking block is respectively arranged on one side and one end of the second auxiliary spring adjusting block. The support rod 30 is connected with a first gear 31. The first gear is engaged with a second gear 32. The second gear is connected with the first adjusting rod 7. The cross section of the support rod is in a hexagon shape. A hexagonal hole adapting to the cross section of the support rod is respectively formed in the middle of the first auxiliary spring adjusting block 28 and the second auxiliary spring adjusting block 29. An outer end of the first adjusting rod 7 is connected with a first adjusting handwheel 33. A divided wheel 34 penetrates through the support rod 30. A small compression spring 35 is arranged on the main body 1. The small compression spring is connected with a steel ball 36. The steel ball jacks on the divided wheel.

Figure 6:
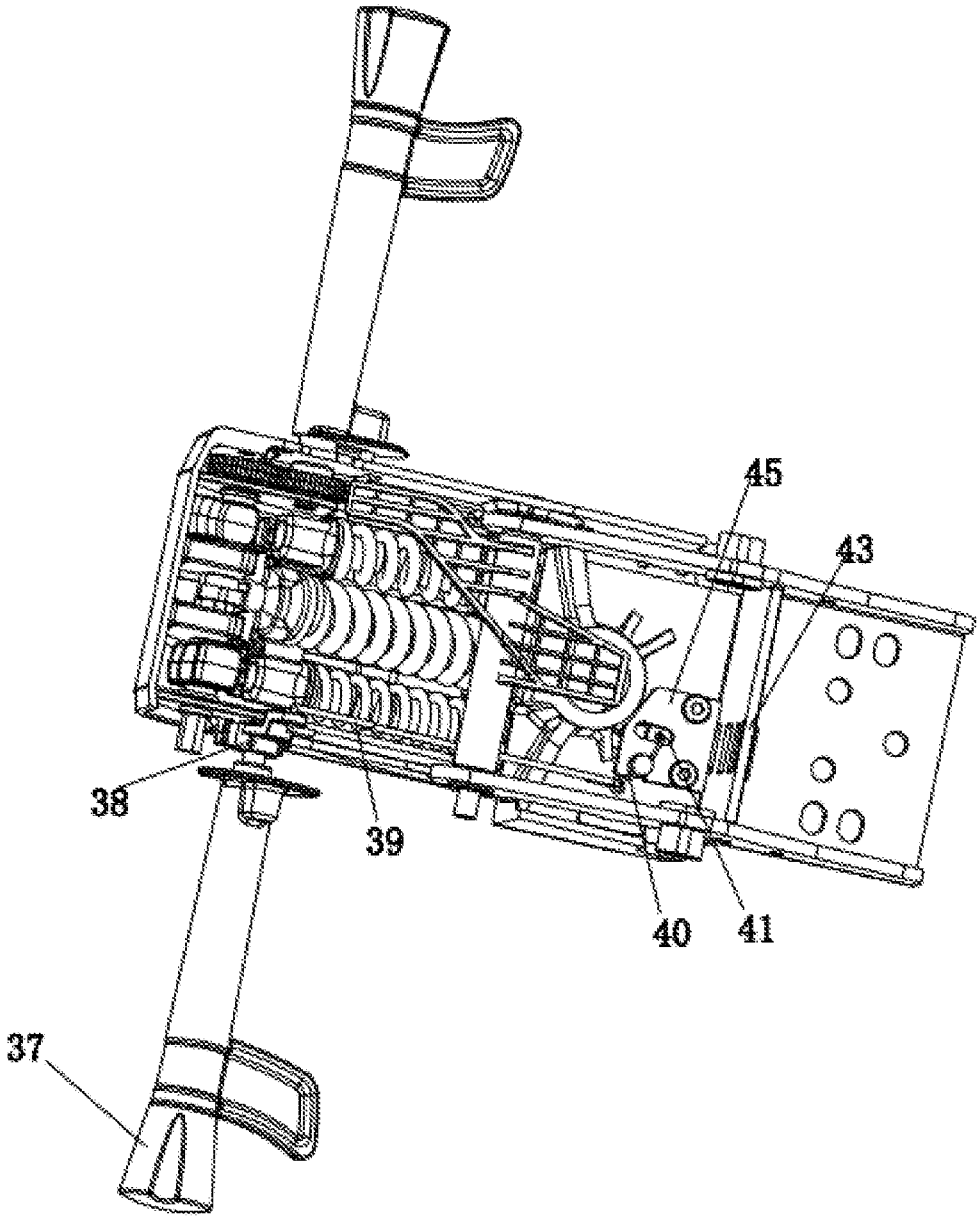
FIG. 6 is a schematic structure diagram of a gear adjusting mechanism of the present invention.

As shown in FIG. 6, the gear adjusting mechanism includes a second adjusting handwheel 37 connected with an outer end of the second adjusting rod 8. An inner end of the second adjusting rod is connected with a gear adjusting block 38. The gear adjusting block is connected with a gear pull rod 39. The other end of the gear pull rod is connected with a locking pad 41 through a gear torsion spring 40. A warping plate protection pad 42 is connected onto the warping plate 4. An inner side of the warping plate is connected with a gear pad 43. A plurality of lock holes 44 are formed in a longitudinal direction of the gear pad, and the locking pad is capable of being inserted into the plurality of lock holes. An elastic block 18 is arranged below the gear adjusting block 38. A pressing plate 45 is fixed on the main body. The pressing plate is positioned above the locking pad 41. A screw 46 is arranged on the pressing plate. The gear torsion spring 40 is connected onto the screw. The gear torsion spring penetrates through a long hole formed in the pressing plate to be connected with the locking pad.

Figure 7:
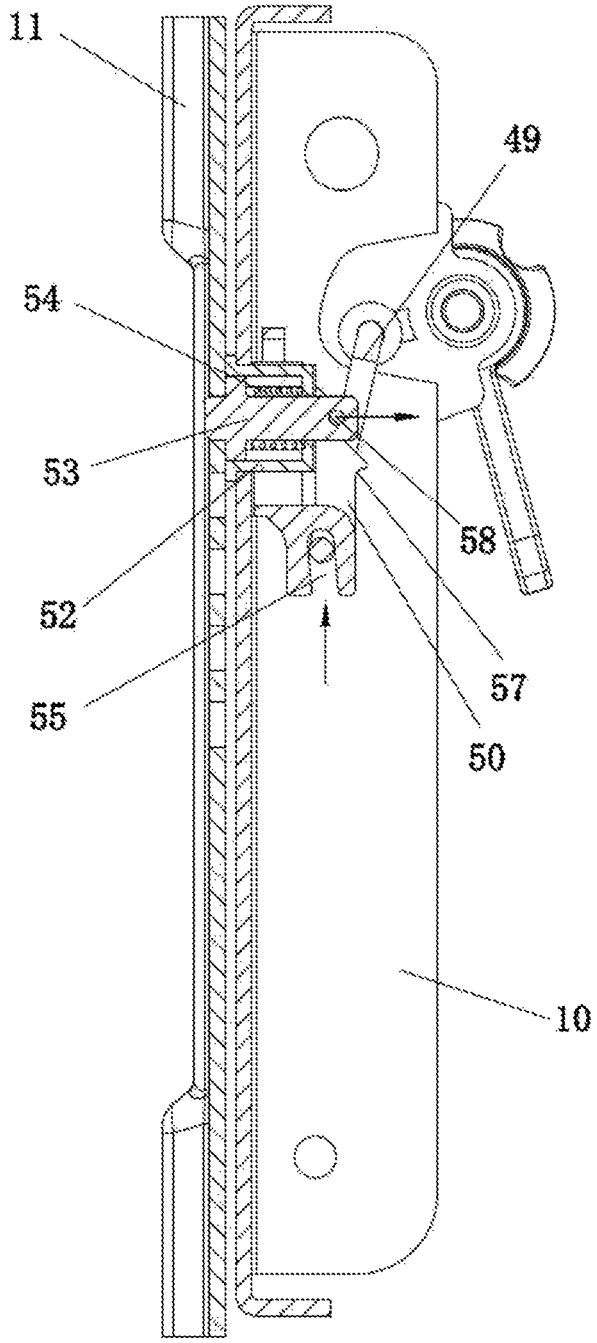
FIG. 7 is a schematic structure diagram of a slide plate locking mechanism of the present invention.
Figure 8:
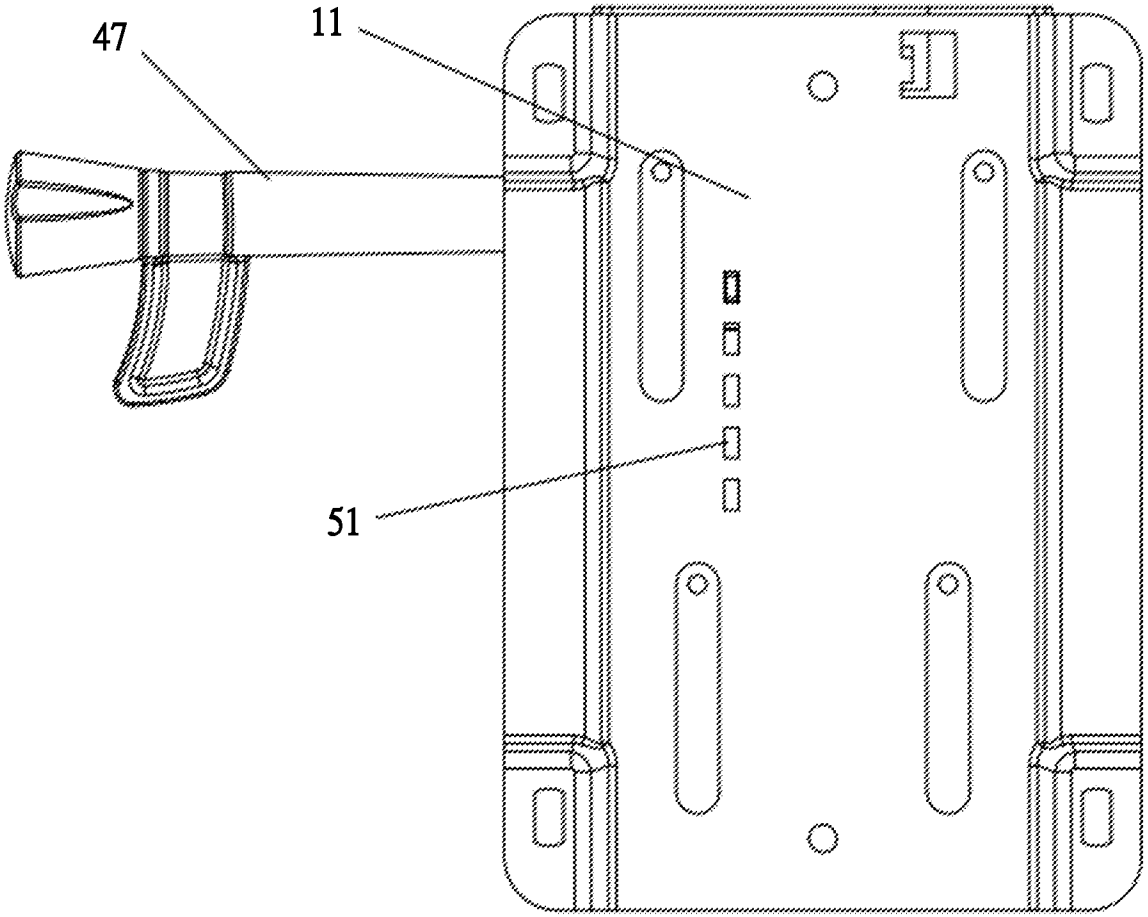
FIG. 8 is a left-view schematic structure diagram of FIG. 7.
Figure 9:
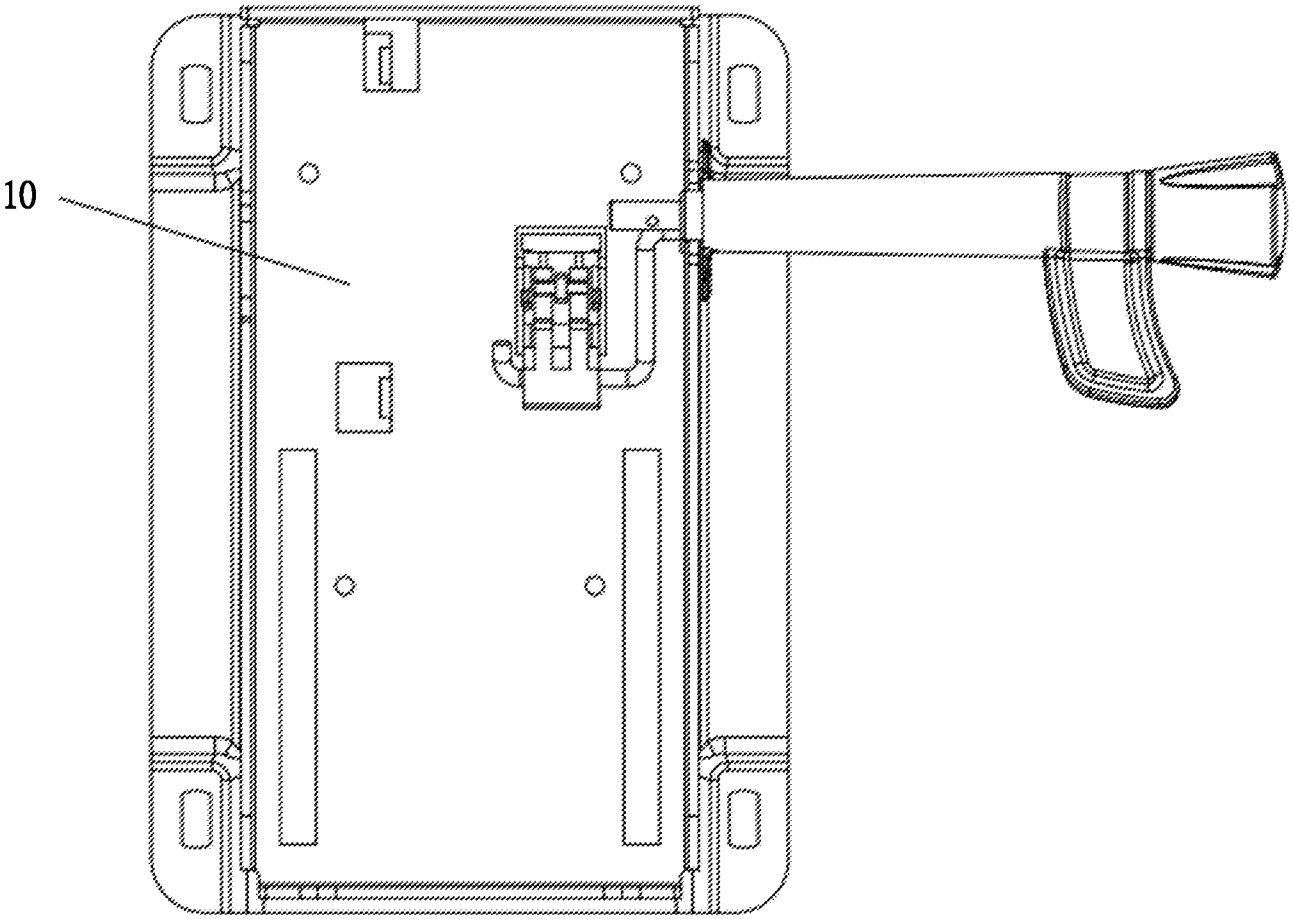
FIG. 9 is a right-view schematic structure diagram of FIG. 7.

As shown in FIG. 7, FIG. 8 and FIG. 9, the slide plate locking mechanism includes a second handle 47 connected to the other side of the main body 1. The second handle is sleeved outside of the second adjusting rod 8. A slide plate adjusting plate 48 is arranged at an inner end of the second handle. The slide plate adjusting plate is connected with a slide plate pull rod 49. The slide plate pull rod is connected with an adjusting block 50. A plurality of slide plate lock holes 51 are formed in the slide plate 11. A fixing seat 52 is fixed on the base plate 10. A slide plate locking pad 53 capable of being inserted into the slide plate lock holes is arranged in the fixing seat. The slide plate locking pad is in a crisscross shape. A slide plate compression spring 54 is arranged between the slide plate locking pad and the fixing seat. A position limiting slide groove 55 is formed in the adjusting block 50. The slide plate pull rod 49 penetrates through the position limiting slide groove. An inclined surface 56 is arranged on the adjusting block. A clamp groove 57 is respectively formed in an upper end and a lower end of the inclined surface. A clamp pin 58 capable of sliding on the inclined surface is connected onto the slide plate locking pad 53.

A use method of the multifunctional swivel chair tray includes as follows.

a. When an ascending and descending function is used, as shown in FIG. 2, the first handle 12 is rotated, so that the ascending and descending adjusting plate 13 at the inner end of the first handle drives the ascending and descending pull rod 14 to move. The ascending and descending pull rod is in contact with the first plate member 15 of the ascending and descending block 6 and drives the ascending and descending block to swing around the second rotating shaft 5. The second plate member 16 of the ascending and descending block is capable of being in contact with the air pressure rod at the ascending and descending rod connecting hole 2 so as to open an air path and complete ascending and descending of a chair.

b. When a multi-spring grouping adjusting function is used, the first adjusting handwheel 33 is rotated, so that the first adjusting handwheel drives the second gear 32 to rotate through the first adjusting rod 7, and the second gear drives the support rod 30 to rotate through the first gear 31. The support rod drives the first auxiliary spring adjusting block 28 and the second auxiliary spring adjusting block 29 to rotate. The divided wheel 34 penetrating through the support rod rotates under the joint effect of the small compression spring 35 and the steel ball 36, and per quarter circle of rotation of the divided wheel is one station.

Firstly, the first auxiliary spring adjusting block 28 is not in contact with the third auxiliary spring seat 26, and the second auxiliary spring adjusting block 29 is not in contact with the fourth auxiliary spring seat 27. That is, both the first auxiliary spring 24 and the second auxiliary spring 25 are not stressed, and only the main spring 20 is stressed.

The support rod 30 drives the divided wheel 34 to rotate for a quarter circle. The first auxiliary spring adjusting block 28 is in contact with the third auxiliary spring seat 26, and the second auxiliary spring adjusting block 29 is not in contact with the fourth auxiliary spring seat 27. That is, the second auxiliary spring 25 is not stressed, and the main spring 20 and the first auxiliary spring 24 are stressed.

The support rod 30 drives the divided wheel 34 to rotate for a quarter circle again. The first auxiliary spring adjusting block 28 is not in contact with the third auxiliary spring seat 26, and the second auxiliary spring adjusting block 29 is in contact with the fourth auxiliary spring seat 27. That is, the third auxiliary spring seat 26 is not stressed, and the main spring 20 and the second auxiliary spring adjusting block 29 are stressed.

The support rod 30 drives the divided wheel 34 to rotate for a quarter circle again. The first auxiliary spring adjusting block 28 is in contact with the third auxiliary spring seat 26, and the second auxiliary spring adjusting block 29 is in contact with the fourth auxiliary spring seat 27. That is, the third auxiliary spring seat 26, the second auxiliary spring adjusting block 29 and the main spring 20 are all stressed.

c. When a gear adjusting function is used, as shown in FIG. 6, and after the warping plate 4 is swung to a certain position, the second adjusting handwheel 37 is rotated, and the second adjusting rod 8 drives the gear adjusting block 38 to rotate. The elastic block 18 positions the gear adjusting block. The gear adjusting block drives the gear pull rod 39 to pull the gear torsion spring 40. After the gear torsion spring rotates, the locking pad 41 is driven to extend out. The locking pad is capable of being inserted into one of the plurality of lock holes 44 of the gear pad 43. After the second adjusting handwheel 37 is rotated reversely, the locking pad 41 is capable of leaving away from the lock hole 44. The warping plate is capable of freely moving.

d. When a slide plate locking function is used, the second handle 47 is rotated, and the slide plate adjusting plate 48 at the inner end of the second handle drives the slide plate pull rod 49 to move. The slide plate pull rod pulls the adjusting block 50. The clamp pin 58 is capable of sliding on the inclined surface 56. After the clamp pin 58 is positioned in the high-position clamp groove 57, the slide plate locking pad 53 is capable of leaving away from the slide plate lock hole 51 on the slide plate 11. Relative free sliding is capable of being realized between the slide plate and the base plate. After the second handle is released, the slide plate locking pad 53 is jacked back into the adjusted slide plate lock hole 51 by using the elasticity of the slide plate compression spring 54. The slide plate locking function is realized. At the same time, through force transmission by the clamp pin 58, the adjusting block 50 is capable of being retreated back to an initial position.

Figure 10:
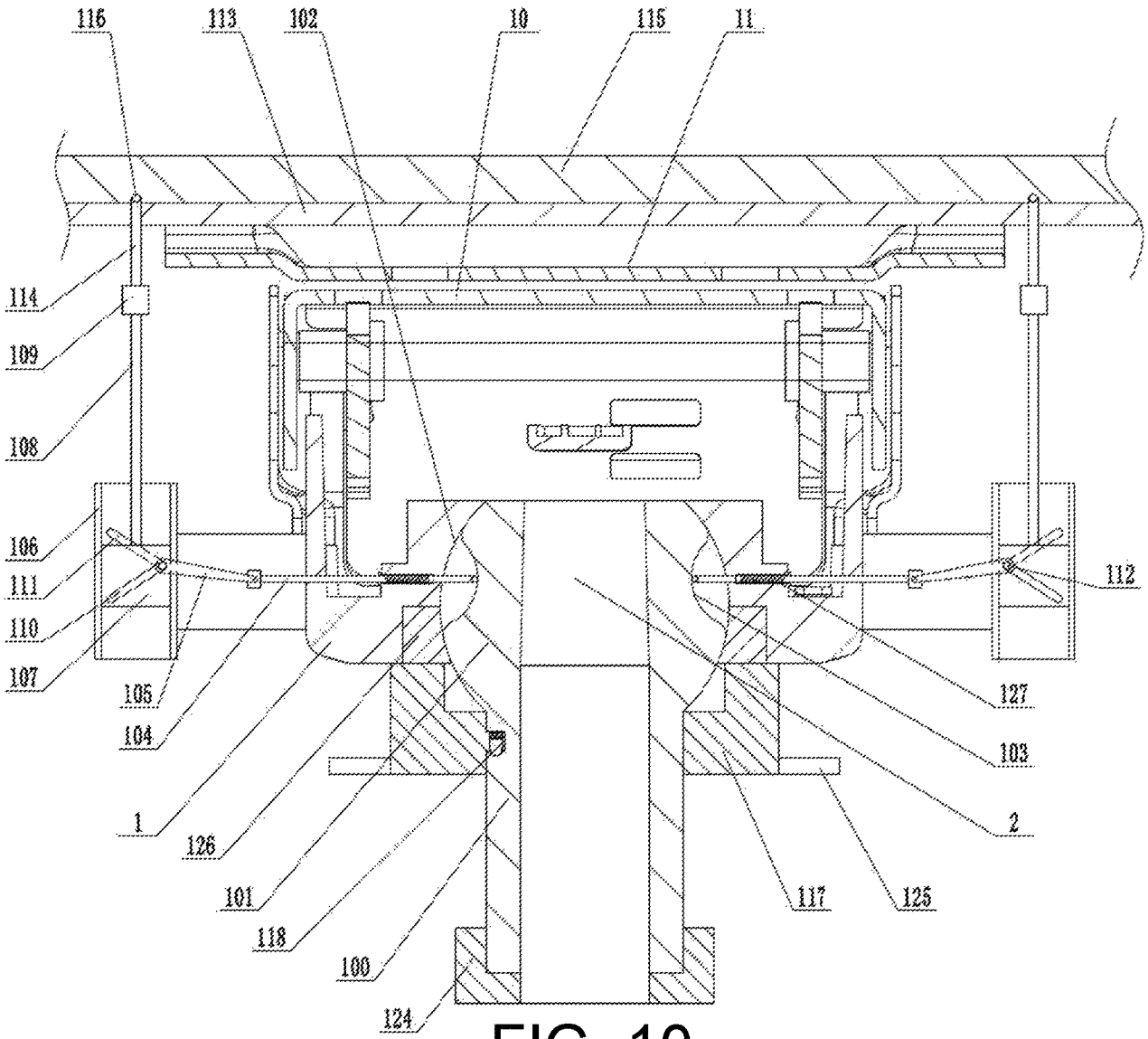
FIG. 10 is a cross-sectional view of Embodiment 2 of the present invention.
Figure 11:
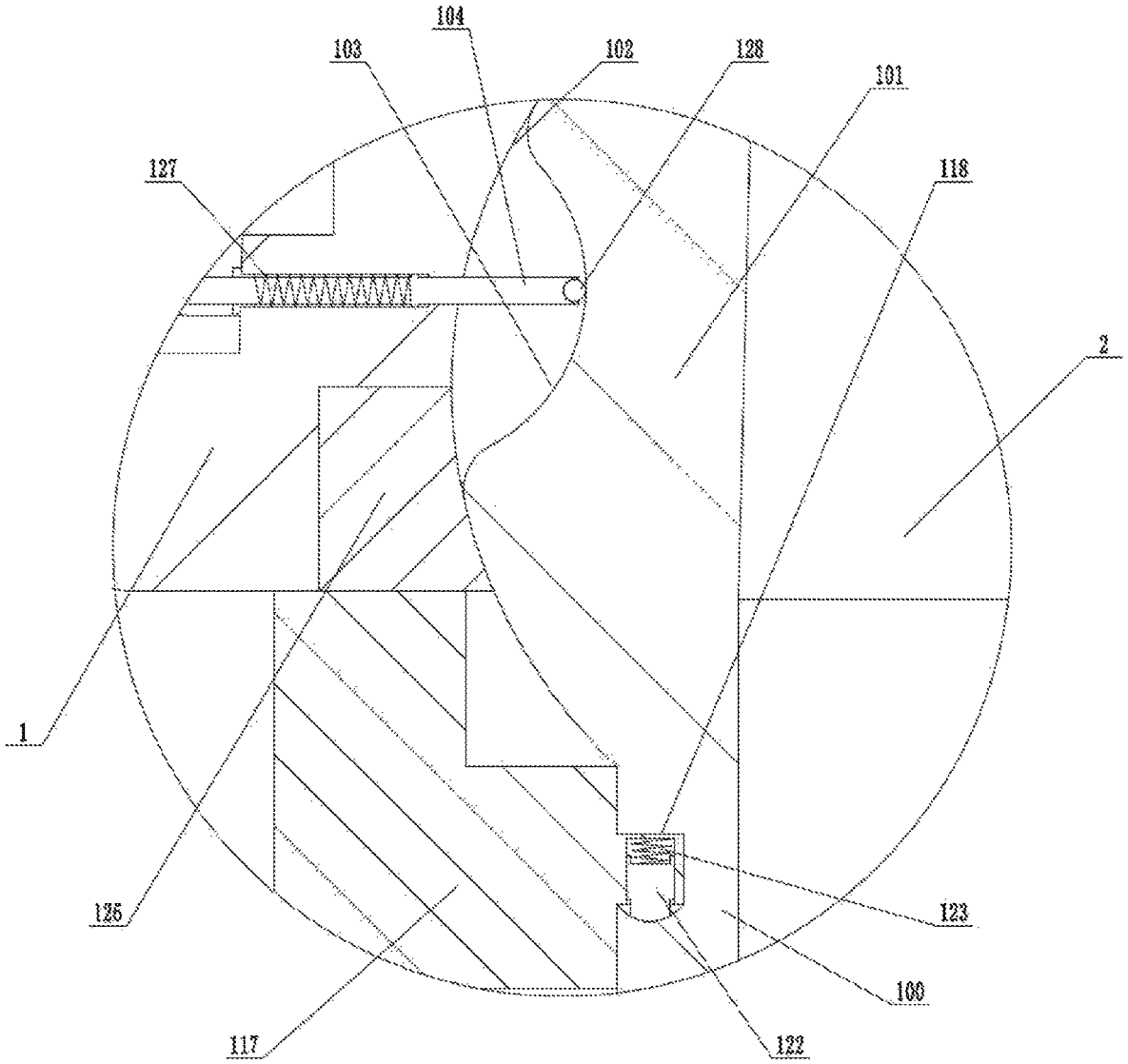
FIG. 11 is a schematic local enlarged diagram of FIG. 10 of the present invention.
Figure 12:
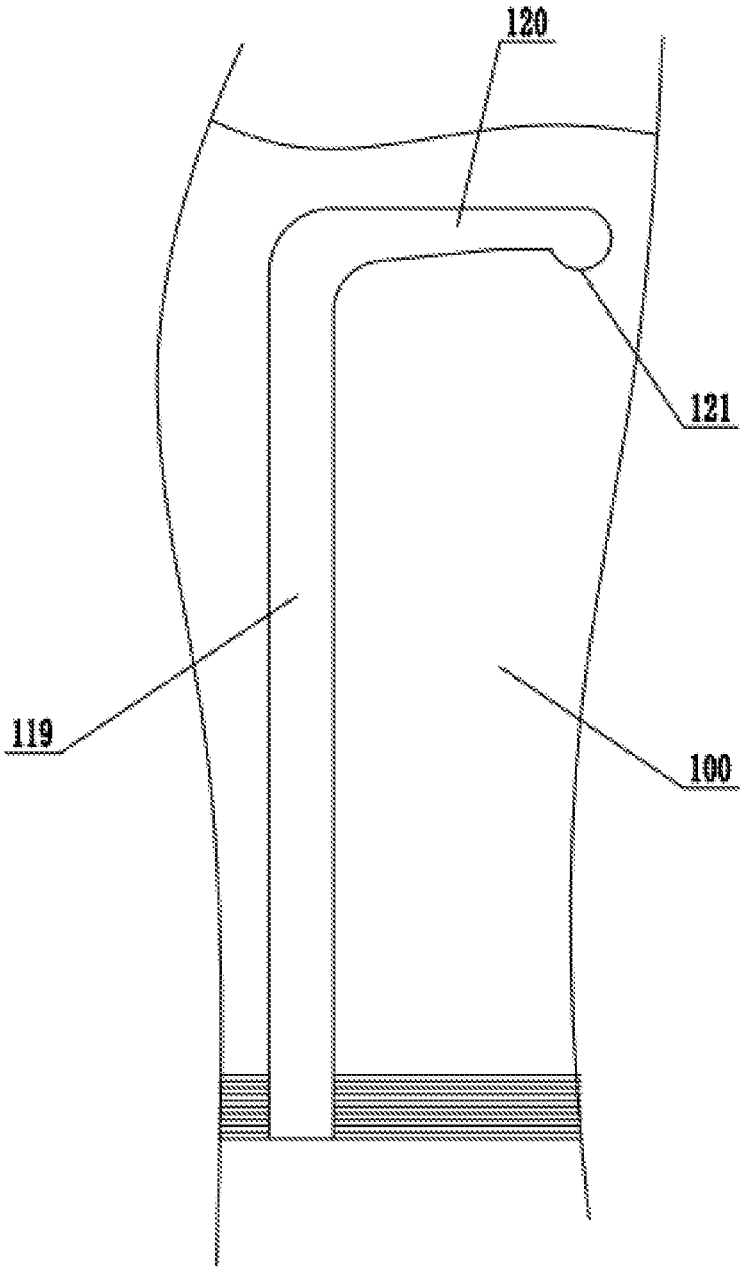
FIG. 12 is a schematic local diagram of an outer wall of a connecting seat of Embodiment 2 of the present invention.

Embodiment 2: A multifunctional swivel chair tray, as shown in FIG. 10, FIG. 11 and FIG. 12, has a structure similar to that of Embodiment 1. A main difference point is that in the present embodiment, a connecting seat 100 is connected onto the main body. An ascending and descending rod connecting hole penetrates through upper and lower ends of the connecting seat. A universal ball head 101 is arranged at the upper end of the connecting seat. A spherical slotted hole 102 is formed in the main body. The universal ball head is mounted in the spherical slotted hole in a way of being capable of performing universal rotation. A circle of guide groove 103 uniformly distributed in a circumference direction is arranged on an outer wall of the universal ball head. The guide groove is of an inwards recessed arc-shaped curve surface structure. A plurality of massage mechanisms are uniformly distributed and mounted on the main body. The massage mechanism includes a push rod 104, a connecting rod 105, an ascending and descending guide groove 106, a slide block 107, an ascending and descending rod 108 and an ascending and descending seat 109. The ascending and descending guide groove is fastened and connected onto the main body. The push rod is movably inserted and mounted on the main body. One end of the push rod is abutted against and connected onto the guide groove, and the other end is hinged to the connecting rod. The slide block is mounted on the ascending and descending guide groove in a way of being capable of vertically sliding. A first pushing groove 110 in inclined arrangement is formed in the slide block. A second pushing groove 111 in inclined arrangement is formed in the ascending and descending guide groove. The first pushing groove and the second pushing groove form a V-shaped structure together. A hinging rod 112 is connected between the first pushing groove and the second pushing groove. The connecting rod and the hinging rod are hinged together. A lower end of the ascending and descending rod is connected with the slide block. An upper end of the ascending and descending rod is connected with the ascending and descending seat. A plurality of massage rods 114 configured to penetrate through a chair base plate 113 are arranged on the ascending and descending seat at intervals. A seat cushion 115 is arranged on the chair base plate. A massage head 116 for massaging the hip is arranged at an upper end of the massage rod. The massage head is arranged at a lower end position of the seat cushion. A support seat 117 capable of realizing ascending and descending locking is sleeved over the connecting seat. The main body is supported on the support seat. A plurality of locking posts 118 are arranged on an inner wall of the support seat. A plurality of L-shaped guide grooves are formed in an outer wall of the connecting seat in a way of being in one-to-one correspondence with the locking posts. The locking posts are inserted in the guide grooves in an adaptive way. The guide groove includes a longitudinal guide groove 119 and a transverse guide groove 120. A downwards recessed locking groove 121 is formed in an end portion of the transverse guide groove. The width of the transverse guide groove is gradually reduced in a direction approaching the locking groove. An outwards extending locking head 122 is arranged on a lower end of the locking post. A locking spring 123 is mounted between the locking head and the locking post. A lower end of the locking head is abutted against and connected into the locking groove. The lower end of the connecting seat is connected with a position limiting sleeve 124. A plurality of pulling handles 125 are uniformly distributed and arranged on an outer wall of the support seat. An expansion groove is formed in the edge of the spherical slotted hole on a lower end surface of the main body. A position limiting cover 126 is mounted in the expansion groove. An inner wall of the position limiting cover is attached to the outer wall of the universal ball head in an adaptive way. The inner diameter of an upper end of the position limiting cover is close to the outer diameter of the universal ball head. The inner diameter of a lower end of the position limiting cover is smaller than the outer diameter of the universal ball head. A reset spring 127 is mounted between the push rod and the main body. A rolling ball 128 is arranged at an end portion of the push rod. Other structures are identical to those in Embodiment 1.

According to a use method of the multifunctional swivel chair tray, after long-time sitting, posture adjusting massage is capable of being performed. The support seat is moved downwards, so that the support seat leaves away from the main body. When the support seat moves, anticlockwise rotation is firstly performed. The locking head leaves away from the locking groove. After the locking post reaches the other end of the transverse guide groove, the support seat is downwards pulled, so that the support seat leaves away from the main body and is supported on the position limiting sleeve. At this time, universal rotation is capable of being realized between the universal ball head and the spherical slotted hole on the main body. A person sitting on the chair swings while rotating. When the end portion of the push rod slides onto the outer wall of the universal ball head from the guide groove, the push rod is outwards pushed out. The slide block is driven to move upwards through the connecting rod, the first pushing groove and the second pushing groove, so that the massage rod moves upwards, the massage head is abutted against and connected onto the seat cushion to perform touching massage on the hip of the human body. The numbness of the hip after long-time sitting is prevented. When the end portion of the push rod slides into the guide groove from the outer wall of the universal ball head, under the effect of the reset spring, the push rod moves inwards, and the massage rod is driven to move downwards. The support seat is moved upwards and rotated clockwise. After the locking head slides into the locking groove, locking is performed, so that the main body is supported on the support seat to limit the positions of the guide groove and the universal ball head, and mutual swinging between the guide groove and the universal ball head is prevented.

The above is merely specific embodiments of the present invention, but the structural characteristics of the present invention are not limited thereto. Changes or modifications made by any of those skilled in the art in the field of the present invention all fall within the patent scope of the present invention.

What is claimed is:

1. A multifunctional swivel chair tray, comprising a main body, wherein an ascending and descending rod connecting hole is formed in the main body, a base plate and a warping plate are connected to a first rotating shaft, the main body is connected with the warping plate through a second rotating shaft, an ascending and descending block penetrates through the second rotating shaft, the ascending and descending block is positioned above the ascending and descending rod connecting hole, the ascending and descending block is connected with an ascending and descending driving mechanism, a first adjusting rod penetrates through a first side of the main body, the first adjusting rod is connected with a multi-spring grouping adjusting mechanism, a second adjusting rod is disposed on a second side of the main body, the second adjusting rod is connected with a gear adjusting mechanism, the warping plate is connected with the base plate through a third rotating shaft, a slide plate is slidably connected onto the base plate, and a slide plate locking mechanism is located between the base plate and the slide plate.

2. The multifunctional swivel chair tray according to claim 1, wherein the ascending and descending driving mechanism comprises a first handle connected to the first side of the main body, the first handle is sleeved outside of the first adjusting rod, an ascending and descending adjusting plate is disposed at an inner end of the first handle, the ascending and descending adjusting plate is connected with an ascending and descending pull rod, the an end of the ascending and descending pull rod is in contact with the ascending and descending block, the ascending and descending block comprises a pipe body penetrating through the second rotating shaft, a first plate member capable of touching the ascending and descending pull rod and a second plate member capable of being in contact with an air pressure rod at the ascending and descending rod connecting hole are respectively disposed on the pipe body, and the first plate member and the second plate member face opposite directions.

3. The multifunctional swivel chair tray according to claim 2, wherein the multi-spring grouping adjusting mechanism comprises a first main spring seat, a first auxiliary spring seat and a second auxiliary spring seat connected onto the warping plate, the first main spring seat is connected with a main spring, an end of the main spring is fixed on the main body through a second main spring seat, the first auxiliary spring seat and the second auxiliary spring seat are respectively connected with a first auxiliary spring and a second auxiliary spring, an end of the first auxiliary spring is connected with a third auxiliary spring seat, the other end of the second auxiliary spring is connected with a fourth auxiliary spring seat, an adjusting mechanism is respectively disposed at an outer end of the third auxiliary spring seat and an outer end of the fourth auxiliary spring seat, and a guide block is disposed below the first auxiliary spring and the second auxiliary spring.

4. The multifunctional swivel chair tray according to claim 3, wherein the adjusting mechanism at an outer end of the third auxiliary spring seat comprises a first auxiliary spring adjusting block, the adjusting mechanism at the outer end of the fourth auxiliary spring seat comprises a second auxiliary spring adjusting block, the first auxiliary spring adjusting block and the second auxiliary spring adjusting block penetrate through a support rod, a jacking block is respectively disposed at two ends of the first auxiliary spring adjusting block, and the jacking block is respectively disposed on one side and one end of the second auxiliary spring adjusting block.

5. The multifunctional swivel chair tray according to claim 4, wherein the support rod is connected with a first gear, the first gear is engaged with a second gear, the second gear is connected with the first adjusting rod, a cross section of the support rod is in a hexagon shape, a hexagonal hole complementary to the cross section of the support rod is respectively formed in the middle of the first auxiliary spring adjusting block and the second auxiliary spring adjusting block, an outer end of the first adjusting rod is connected with a first adjusting handwheel, a divided wheel penetrates through the support rod, a small compression spring is disposed on the main body, the small compression spring is connected with a steel ball, and the steel ball jacks on the divided wheel.

6. A using method of the multifunctional swivel chair tray according to claim 5, the using method comprising:

a. when an ascending and descending function is used, rotating the first handle, so that the ascending and descending adjusting plate at the inner end of the first handle drives the ascending and descending pull rod to move, the ascending and descending pull rod is in contact with the first plate member of the ascending and descending block and drives the ascending and descending block to swing around the second rotating shaft, the second plate member of the ascending and descending block is capable of being in contact with the air pressure rod at the ascending and descending rod connecting hole so as to open an air path and complete ascending and descending of a chair; and b. when a multi-spring grouping adjusting function is used, rotating the first adjusting handwheel, so that the first adjusting handwheel drives the second gear to rotate through the first adjusting rod, the second gear drives the support rod to rotate through the first gear, the support rod drives the first auxiliary spring adjusting block and the second auxiliary spring adjusting block to rotate, the divided wheel penetrating through the support rod rotates under the joint effect of the small compression spring and the steel ball, and per quarter circle of rotation of the divided wheel is one station;

wherein the first auxiliary spring adjusting block is not in contact with the third auxiliary spring seat, the second auxiliary spring adjusting block is not in contact with the fourth auxiliary spring seat, both the first auxiliary spring and the second auxiliary spring are not stressed, and only the main spring is stressed;

the support rod drives the divided wheel to rotate for a quarter circle, the first auxiliary spring adjusting block is in contact with the third auxiliary spring seat, the second auxiliary spring adjusting block is not in contact with the fourth auxiliary spring seat, the second auxiliary spring is not stressed, and the main spring and the first auxiliary spring are stressed;

the support rod drives the divided wheel to rotate for a quarter circle again, the first auxiliary spring adjusting block is not in contact with the third auxiliary spring seat, the second auxiliary spring adjusting block is in contact with the fourth auxiliary spring seat, the third auxiliary spring seat is not stressed, and the main spring and the second auxiliary spring adjusting block are stressed; and the support rod drives the divided wheel to rotate for a quarter circle again, the first auxiliary spring adjusting block is in contact with the third auxiliary spring seat, and the second auxiliary spring adjusting block is in contact with the fourth auxiliary spring seat, the third auxiliary spring seat, the second auxiliary spring adjusting block and the main spring are all stressed.

7. The multifunctional swivel chair tray according to claim 5, wherein the gear adjusting mechanism comprises a second adjusting handwheel connected with an outer end of the second adjusting rod, an inner end of the second adjusting rod is connected with a gear adjusting block, the gear adjusting block is connected with a gear pull rod, an end of the gear pull rod is connected with a locking pad through a gear torsion spring, a warping plate protection pad is connected onto the warping plate, an inner side of the warping plate is connected with a gear pad, a plurality of lock holes are formed in a longitudinal direction of the gear pad, and the locking pad is capable of being inserted into the plurality of lock holes.

8. The multifunctional swivel chair tray according to claim 7, wherein an elastic block is disposed below the gear adjusting block, a pressing plate is fixed on the main body, the pressing plate is positioned above the locking pad, a screw is disposed on the pressing plate, the gear torsion spring is connected onto the screw, and the gear torsion spring penetrates through a long hole formed in the pressing plate to be connected with the locking pad.

9. A using method of the multifunctional swivel chair tray according to claim 8, the using method comprising:

after the warping plate is swung to a certain position, rotating the second adjusting handwheel, wherein the second adjusting rod drives the gear adjusting block to rotate, the elastic block positions the gear adjusting block, the gear adjusting block drives the gear pull rod to pull the gear torsion spring, after the gear torsion spring rotates, the locking pad is driven to extend out, and the locking pad is capable of being inserted into one of the plurality of lock holes of the gear pad, after the second adjusting handwheel is rotated reversely, the locking pad is capable of leaving away from the lock hole, and the warping plate is capable of freely moving.

10. The multifunctional swivel chair tray according to claim 1, wherein the slide plate locking mechanism comprises a second handle connected to the second side of the main body, the second handle is sleeved outside of the second adjusting rod, a slide plate adjusting plate is disposed at an inner end of the second handle, the slide plate adjusting plate is connected with a slide plate pull rod, the slide plate pull rod is connected with an adjusting block, a plurality of slide plate lock holes are formed in the slide plate, a fixing seat is fixed on the base plate, a slide plate locking pad capable of being inserted into the slide plate lock holes is disposed in the fixing seat, the slide plate locking pad is in a crisscross shape, and a slide plate compression spring is arranged between the slide plate locking pad and the fixing seat.

11. The multifunctional swivel chair tray according to claim 10, wherein a position limiting slide groove is formed in the adjusting block, the slide plate pull rod penetrates through the position limiting slide groove, an inclined surface is disposed on the adjusting block, a clamp groove is respectively formed in an upper end and a lower end of the inclined surface, and a clamp pin capable of sliding on the inclined surface is connected onto the slide plate locking pad.

12. A using method of the multifunctional swivel chair tray according to claim 11, the using method comprising:

rotating the second handle, wherein the slide plate adjusting plate at the inner end of the second handle drives the slide plate pull rod to move, the slide plate pull rod pulls the adjusting block, the clamp pin is capable of sliding on the inclined surface, after the clamp pin is positioned in the high-position clamp groove, the slide plate locking pad is capable of leaving away from the slide plate lock hole on the slide plate, and relative free sliding is capable of being realized between the slide plate and the base plate; and after the second handle is released, jacking the slide plate locking pad back into the adjusted slide plate lock hole by using the elasticity of the slide plate compression spring, so as to realize slide plate locking function, and at the same time, through force transmission by the clamp pin, the adjusting block is capable of being retreated back to an initial position.

13. The multifunctional swivel chair tray according to claim 1, wherein a connecting seat is connected onto the main body, the ascending and descending rod connecting hole penetrates through upper and lower ends of the connecting seat, a universal ball head is disposed at the upper end of the connecting seat, a spherical slotted hole is formed in the main body, the universal ball head is mounted in the spherical slotted hole in a way of being capable of performing universal rotation, a circle of guide groove uniformly distributed in a circumference direction is disposed on an outer wall of the universal ball head, the guide groove is of an inwards recessed arc-shaped curve surface structure, a plurality of massage mechanisms are uniformly distributed and mounted on the main body, each of the massage mechanisms comprises a push rod, a connecting rod, an ascending and descending guide groove, a slide block, an ascending and descending rod and an ascending and descending seat, the ascending and descending guide groove is fastened and connected onto the main body, the push rod is movably inserted and mounted on the main body, one end of the push rod is abutted against and connected onto the guide groove, the other end of the push rod is hinged to the connecting rod, the slide block is mounted on the ascending and descending guide groove in a way of being capable of vertically sliding, a first pushing groove in inclined arrangement is formed in the slide block, a second pushing groove in inclined arrangement is formed in the ascending and descending guide groove, the first pushing groove and the second pushing groove form a V-shaped structure together, a hinging rod is connected between the first pushing groove and the second pushing groove, the connecting rod and the hinging rod are hinged together, a lower end of the ascending and descending rod is connected with the slide block, an upper end of the ascending and descending rod is connected with the ascending and descending seat, a plurality of massage rods configured to penetrate through a chair base plate are disposed on the ascending and descending seat at intervals, a seat cushion is disposed on the chair base plate, a massage head for massaging the hip is disposed at an upper end of each of the massage rods, the massage head is disposed at a lower end position of the seat cushion, a support seat capable of realizing ascending and descending locking is sleeved over the connecting seat, and the main body is supported on the support seat.

14. A using method of the multifunctional swivel chair tray according to claim 13, the using method comprising:

moving the support seat downwards, so that the support seat leaves away from the main body, universal rotation is capable of being realized between the universal ball head and the spherical slotted hole on the main body, a person sitting on a chair swings while rotating, when an end portion of the push rod slides onto the outer wall of the universal ball head from the guide groove, the push rod is outwards pushed out, the slide block is driven to move upwards through the connecting rod, the first pushing groove and the second pushing groove, so that the massage rod moves upwards, the massage head is abutted against and connected onto the seat cushion to perform touching massage on the hip of the human body, the numbness of the hip after long-time sitting is prevented;

moving the support seat upwards and locking the support seat, so that the main body is supported on the support seat to limit the positions of the guide groove and the universal ball head, and mutual swinging between the guide groove and the universal ball head is prevented.

* * * * *